US006485325B1

(12) United States Patent
Fukuda

(10) Patent No.: US 6,485,325 B1
(45) Date of Patent: Nov. 26, 2002

(54) WATERPROOF STRUCTURE OF CONNECTOR

(75) Inventor: Masaru Fukuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/577,155

(22) Filed: May 24, 2000

(30) Foreign Application Priority Data

Jun. 10, 1999 (JP) ..... 11-164143

(51) Int. Cl.[7] ..... H01R 13/58
(52) U.S. Cl. ..... 439/465; 439/587
(58) Field of Search ..... 439/587, 467, 439/465, 731, 874, 867, 466; 174/84 R, 88 R

(56) References Cited

U.S. PATENT DOCUMENTS

| | | | | |
|---|---|---|---|---|
| 3,879,239 A | * | 4/1975 | Rager et al. | 156/73.1 |
| 5,356,710 A | * | 10/1994 | Rinehart | 428/378 |
| 5,371,324 A | * | 12/1994 | Kanno et al. | 174/117 F |
| 5,957,735 A | * | 9/1999 | Shinchi | 439/784 |
| 5,967,829 A | * | 10/1999 | Shinchi | 439/467 |
| 6,018,127 A | * | 1/2000 | Shinchi et al. | 174/84 R |
| 6,019,628 A | * | 2/2000 | Shinchi | 439/465 |

FOREIGN PATENT DOCUMENTS

| | | | | |
|---|---|---|---|---|
| GB | 2 342 068 A | | 4/2000 | B29C/65/08 |
| JP | 11-121084 | * | 9/1997 | 439/587 |
| JP | 10-241782 | | 9/1998 | |
| WO | WO 96/17412 | | 6/1996 | H01R/23/66 |

* cited by examiner

*Primary Examiner*—Brian Sircus
*Assistant Examiner*—J. F. Duverne
(74) *Attorney, Agent, or Firm*—Morgan, Lewis & Bockius LLP

(57) ABSTRACT

The terminal of the lead portion of the sheathed electric wire having a resin sheath thereon is connected to the terminal fitting in the connector body 11, and a wire leading part 14 formed of a resin having a wire receiving groove 15 for receiving the terminal of the sheathed electric wire 23 is extending from the connector body 11. The wire leading part 14 and the resin sheath 25 of the sheathed electric wire 23 are heat-welded in the state that the cross sectional configurations of the wire receiving groove 15 and the sheathed electric wire 23 are selected to be the same rectangular shape. Since both resin members are uniformly kept in contact with each other in the stage before heat welding is applied, both resin members are welded surely and uniformly so that a waterproof ability may be enhanced.

7 Claims, 4 Drawing Sheets

WATERPROOF STRUCTURE OF CONNECTOR

BACKGROUND OF THE INVENTION

The present invention relates to a waterproof structure of a connector, and more specifically, to a waterproof structure that improves sealing ability between a connector formed of a synthetic resin and a sheathed electric wire that is to be connected to the connector.

This kind of waterproof structure of a connector is shown in FIG. 6. As shown in the same figure, a connector 1 comprises a connector body 2 and a cover 3 both formed of a synthetic resin, and constructed in such a manner that the sheathed electric wire 4 is connected to and disposed on the connector body 2 and covered by the cover 3.

The connector body 2 comprises a connection housing 5 including connecting terminal fittings (not shown) integrated therein, a wire leading part 6 extending from the connection housing 5. The wire leading part 6 includes a plurality of partition walls 7 along the direction in which the sheathed electric wires 4 extend, and between adjacent partition walls 7, there are provided wire receiving grooves 8 where the sheathed electric wires are disposed.

In order to connect and fix the sheathed electric wire 4 to the connector, as shown in FIG. 6, a tubular waterproof member 9 having compatibility with a synthetic resin which forms the wire leading part 6 under melted condition is fitted onto the periphery of the sheathed electric wire 4, and then the sheathed electric wire 4 is heated under the condition being received in the wire leading part 6 to melt and fuse the waterproof member 9 and the resin cover of the sheathed electric wire 4 together, as well as the waterproof member 9 and the wire leading member 6 together. The portions between cover 3 and the waterproof member 9, and between cover 3 and the wire leading part 6 are also heated to be fused into a whole. An ultrasonic excitation is utilized for the heating operation.

In the related waterproof structure of a connector as described above, the resin material forming the wire leading part 6 of the connector body 2 and the cover is normally different from that forming the cover of the sheathed electric wire 4 because the flexibility or other physical properties required for the sheathed electric wire 4 differs from the physical property required for the connector 1. Therefore, in order to achieve compatibility between the material forming the wire leading part 6 of the connector body 2 and/or the cover and that forming the sheathed electric wire 4, the waterproof member 9 is required to be fitted on the outer periphery of the sheathed electric wire 4. However, there has been a recognized disadvantage that it requires many working processes because the respective sheathed electric wires 4 had to be fitted with the waterproof members 9 at prescribed portions in the vicinity of their terminal portion before the sheathed electric wire 4 is connected to the connector 1.

In the related waterproof structure of a connector as mentioned above, while the cross sectional configuration of the wire receiving groove 8 formed between adjacent partition walls 7 is rectangular, the cross sectional configuration of the sheathed electric wire 4 fitted with the waterproof member 9 is circular. Therefore, the contact between the wire leading part 6 and the waterproof member 9 and the contact between the cover 3 and the waterproof member 9 may not be uniform and thus the waterproof member 9 may not be brought into intimate contact with the wire leading part 6 and/or the cover 3 even after they are heated and melted. As a result, a clearance may be formed between them due to insufficient fusion, and in some circumstances, it may lead to loss of waterproof ability.

SUMMARY OF THE INVENTION

It is therefore an object of the present invention is to provide a waterproof structure of a connector wherein the fitting operation is quite easy and the sealing ability between the sheathed electric wire and the connector housing is enhanced.

In order to achieve the above object, according to the present invention, there is provided a waterproof structure of a connector comprising:

at least one electric wire covered by a resin sheath; and a connector body including:

a connecting part to which one end portion of the sheathed electric wire is connected; and a wire leading part made of a resin material and having a wire receiving groove for receiving the sheathed electric wire connected to the connecting part, the wire receiving groove having a cross sectional shape substantially identical with a cross sectional shape of the sheathed electric wire so that the inner surface of the wire receiving groove and the outer surface of the sheathed wire is to be heat-welded.

According to the above configuration, the resin sheath of the sheathed electric wire is brought into intimate contact with the inner surface of the wire receiving groove. By heat-welding them in this state, the resin material of the wire leading part and the resin sheath of the sheathed electric wire are fused to establish a satisfactory waterproof structure without forming a clearance between the wire receiving groove and the sheathed electric wire.

Preferably, the resin sheath integrally covers at least one end portions of a plurality of electric wires.

According to the above configuration, it is not necessary to form partition walls to isolate respective sheathed electric wires in the wire receiving groove of the wire leading part, the space required for mounting the sheathed electric wire may be reduced. Therefore, according to the second aspect of the present invention, the connector body may be miniaturized.

Preferably, the resin sheath is made of a thermoplastic elastomer.

According to the above configuration, it exhibits plasticity as heat is added and easily welded to the resin material to form the wire leading part.

Preferably, the thermoplastic elastomer is a copolymer including a resin material forming the wire leading part as a polymerized ingredient.

According to the above configuration, chemical structure of the resin material used for the wire leading part and that used for the resin sheath are similar, and thus fusibility between these members may be enhanced during heat welding so as to obtain a strong connection.

Preferably, the connector body includes a cover body having a shape being brought into an intimate contact with the sheathed electric wire received in the wire receiving groove. The cover body is made of a resin material having compatibility with the resin material of the wire leading part to be heat-welded with the sheathed electric wire and the wire leading part.

According to the above configuration, it ensures fusion among the cover body, the wire leading part, and the resin sheath of the sheathed electric wire by heat welding so that the waterproof ability is further enhanced.

Preferably, the wire leading part, the sheathed wire and the cover body are heat-welded by applying frictional heat energy generated by ultrasonic excitation.

According to the above configuration, an uniform frictional heat energy is generated between itself and adjacent member when ultrasonic excitation is applied, so that an uniform heat welding may be accomplished. Therefore, the waterproof ability of the connector is enhanced without generating any clearance between members.

DETAILED DESCRIPTION OF THE PREFERRED EMBODIMENTS

Hereinafter, a waterproof structure of a connector according to the present invention will be described in detail referring to preferred embodiments shown in the accompanying drawings.

Figure 1:
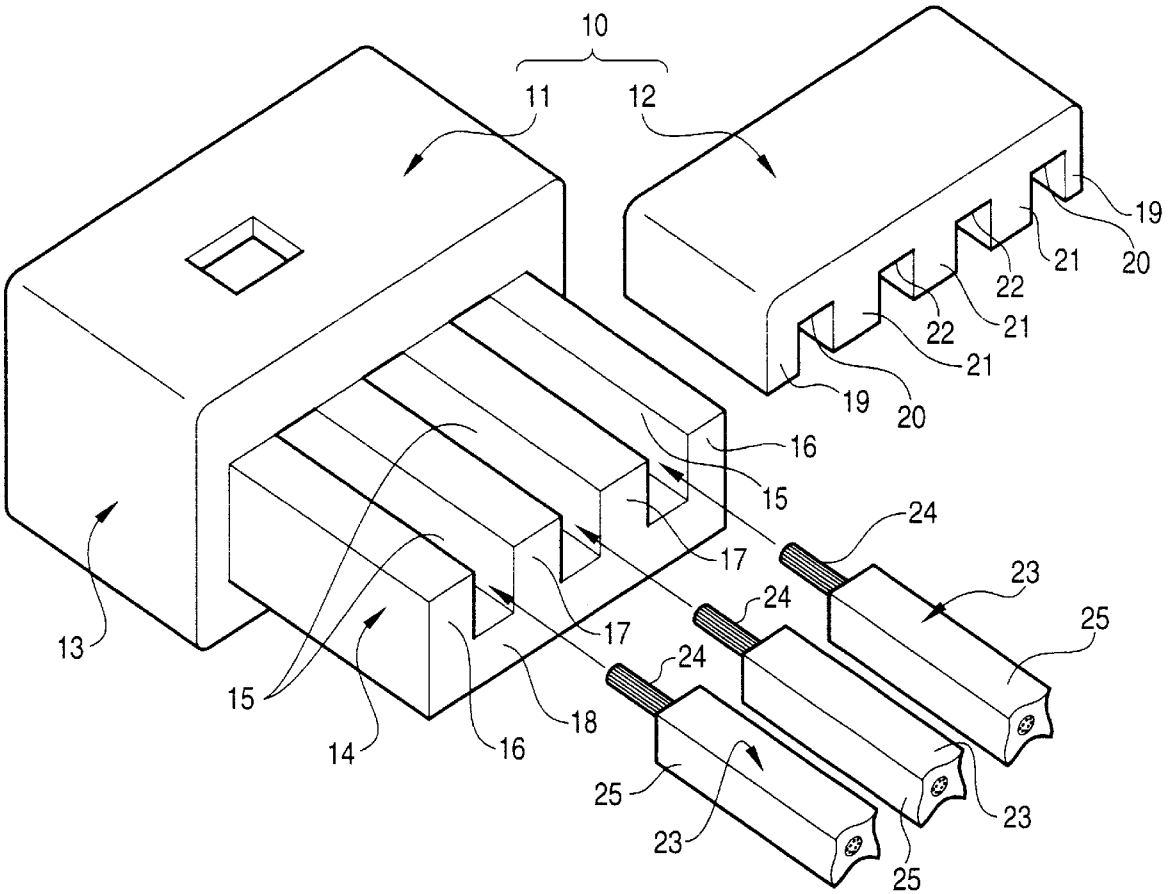
FIG. 1 is an exploded perspective view illustrating a waterproof structure of a connector according to a first embodiment of the present invention.
Figure 2:
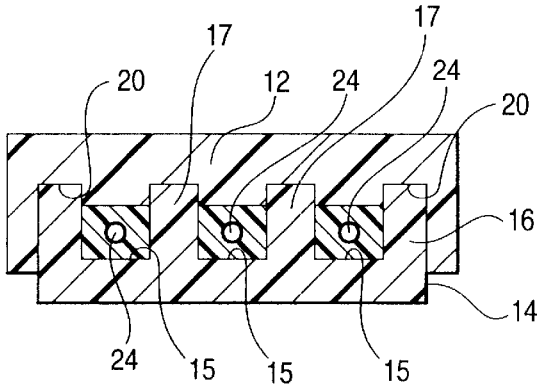
FIG. 2 is a cross sectional view of the waterproof structure of FIG. 1.

FIG. 1 and FIG. 2 illustrate one embodiment of the present invention. Now, the construction of the connector 10 according to the first embodiment will be described referring to FIG. 1. As shown in FIG. 1, the connector 10 of this embodiment comprises a connector body 11 and a connector cover 12.

The connector body 11 comprises a terminal housing 13 having terminal fittings (not shown) disposed therein, and a wire leading part 14 extending from the rear part of the terminal housing 13. The front end face of the terminal housing 13 is provided with openings, in which a connecting portion of the terminal fitting is disposed, used for connection with a mating connector (not shown).

The wire leading part 14 is provided with a plurality of wire receiving grooves 15. These wire receiving grooves 15 are composed of side walls 16 formed widthwise on the both sides of the wire leading part 14, a plurality of partition walls 17 formed in parallel with the side walls 16, and a bottom plate 18. Each wire receiving groove 15 has a cross section in the shape of open top square. The wire receiving groove 15 is in communication with the terminal housing 13 so that a lead portion of a sheathed electric wire can be connected to the terminal fitting disposed in the terminal housing 13.

The connector body 11 is formed of a resin material such as a acrylic resin, ABS (acrylonitrile-butadiene-styrene copolymer) resin, PC (polycarbonate) resin, PVC (polyvinyl chloride) resin, PE (polyethylene) resin, PEI (polyether imide) resin, and PBT (polyethylene phtalate) resin.

The connector cover 12 is formed in the shape corresponding to the wire leading part 14 of the connector body 11 described above. In other words, the connector cover 12 has side walls of the cover 19 of which the inner faces come in contact with the outer faces of the side walls 16 of the wire leading part 14. On the inner side of each side wall of the cover 19, there is provided a side wall receiving groove 20 for fitting and receiving the side wall 16 of the wire leading part 14. Between the side walls of the cover 19, there are provided projections 21 to be fitted into the wire receiving grooves 15 of the wire leading part 14 by a prescribed depth and the partition wall fitting grooves 22 for fitting the partition walls 17 of the wire leading part 14 alternately.

The width of the side wall receiving groove 20 is selected to be almost the same as that of the side wall 16 of the wire leading part 15. The width of the partition wall 17 of the wire leading part 14 is selected to be almost the same as that of the partition wall fitting groove 22 of the connector cover 12. The connector cover 12 having such a structure is formed of the same resin material as the connector body 11.

The sheathed electric wire 23 to be connected to the connector 11, as shown in FIG. 1 and FIG. 2, is constructed such that the resin sheath 25 having a cross section in rectangular shape covers the lead portion, that is, a core. The resin sheath 25 is formed of thermoplastic elastomer such as polyester elastomer. Covering the lead portion 14 with thermoplastic elastomer gives adequate flexibility to the sheathed electric wire 23. Preferably, the cross section of the sheathed electric wire 23 is a square and the width is selected to be almost the same as that of the wire receiving groove 15. The distance between the bottom plate 18 of the wire leading part 14 and the projection 21 of the connector cover 12 with the connector cover 12 covered on the wire leading part 14 is selected to be almost the same as the height (width) of the sheathed electric wire 23.

In this embodiment, while the width and the height of the sheathed electric wire 23 are selected to be the same so that it has square cross section, the cross section may be rectangular or circular. In such cases, the cross section of the wire receiving groove 15 of the wire leading part and that of the projection 21 of the connector cover may be selected to accommodate the configuration of the sheathed electric wire 23.

In order to fit a plurality of sheathed electric wire 23 to the connector 10 comprising a connector body 11 and a connector cover 12 and to give a waterproof ability between the connector and the sheathed electric wire 23, the lead portion of the sheathed electric wire 23 is connected to the terminal fitting in the connector body 11, the terminal portion of the sheathed electric wire 23 is received into the wire receiving groove 15, and ultrasonic excitation is applied with the connector cover 12 covered onto the wire leading part 14 of the connector cover 12. By undergoing ultrasonic excitation, the resin sheath 25 of the sheathed electric wire 23 is welded to the inner wall of the wire receiving groove 15 of the wire leading part 14 and to the lower face of the projection 21 of the connector cover 12. The wire leading part 14 and the connector cover 12 are fixed with all the faces that are in contact with each other welded. The faces of the connector cover 12 and of the terminal housing 13 that are in contact with each other are also welded by ultrasonic excitation.

In the first embodiment having such a structure, the configurations of sheathed electric wire 23, the wire leading part 14 for receiving the sheathed electric wire 23, and the connector cover 12 are selected so that they are brought into intimate contact with each other. Therefore, the sheathed electric wire 23 keep in contact with the surrounding members (the wire leading part 14 and the connector cover 12)

uniformly, frictional heat generated by ultrasonic excitation will be uniform. Therefore, the peripheral face of the sheathed electric wire 23 is welded uniformly to other members so that formation of partial clearance may be prevented. Consequently, a satisfactory waterproof structure between the connector 10 and the sheathed electric wire 23 may be established.

Specifically, when the connector body 11 and the connector cover 12 constituting the connector 10 are formed of PBT and the resin sheath 25 is formed of polyester elastomer, since chemical structure of polyester elastomer is formed of block copolymer of PBT and polyether, compatibility between the sheathed electric wire 23 and the connector 10 will be increased, and thus further satisfactory waterproof structure may be established.

Figure 3:
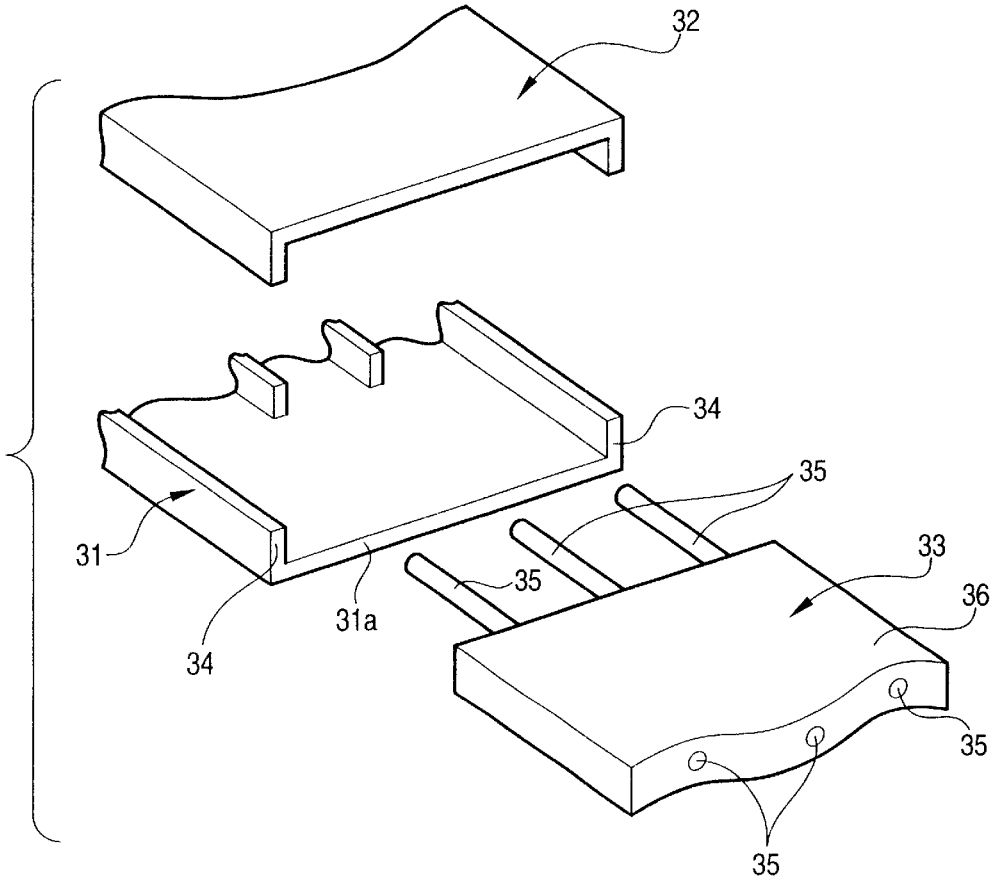
FIG. 3 is an exploded perspective view illustrating a waterproof structure of a connector according to a second embodiment of the present invention.

FIG. 3 is an exploded perspective view illustrating a second embodiment of a waterproof structure of the connector according to the present invention. In the same figure, reference numeral 31 depicts the wire leading part of the connector body, reference numeral 32 depicts a connector cover to cover the wire leading part 31, and reference numeral 33 depicts a sheathed electric wire.

The wire leading part 31 of the connector body is generally composed of side walls 34, and a bottom plate 31 a extending between the bottom portion of the side walls 34.

The sheathed electric wire 33 is so constructed that a plurality of leads 35 are arranged in parallel at established intervals and covered integrally by a resin cover 36. The resin cover 36 is in the shape of a plate as shown in the same figure, and received in the recess formed by the side walls 34 of the wire leading part 31 and the bottom plate 31*a*. The connector cover 32 covers the wire leading part 31 in such a manner that it covers the sheathed electric wire 33 received in the wire leading part 31. Then the wire leading part 31, the connector cover 32, and the sheathed electric wire 33 are all welded with respect to each other by ultrasonic excitation.

Other structures of the second embodiment are almost the same as that of the first embodiment. In the second embodiment, since the sheathed electric wire 33 is flat in shape and includes a plurality of leads 35 integrally therein, the operation to fit the sheathed electric wire 33 into the wire leading part 31 is easier and the uniformity of welding-is enhanced in a wide area because the contact pressure applied between the resin cover 36 and the bottom plate 31*a* is uniform.

Figure 4:
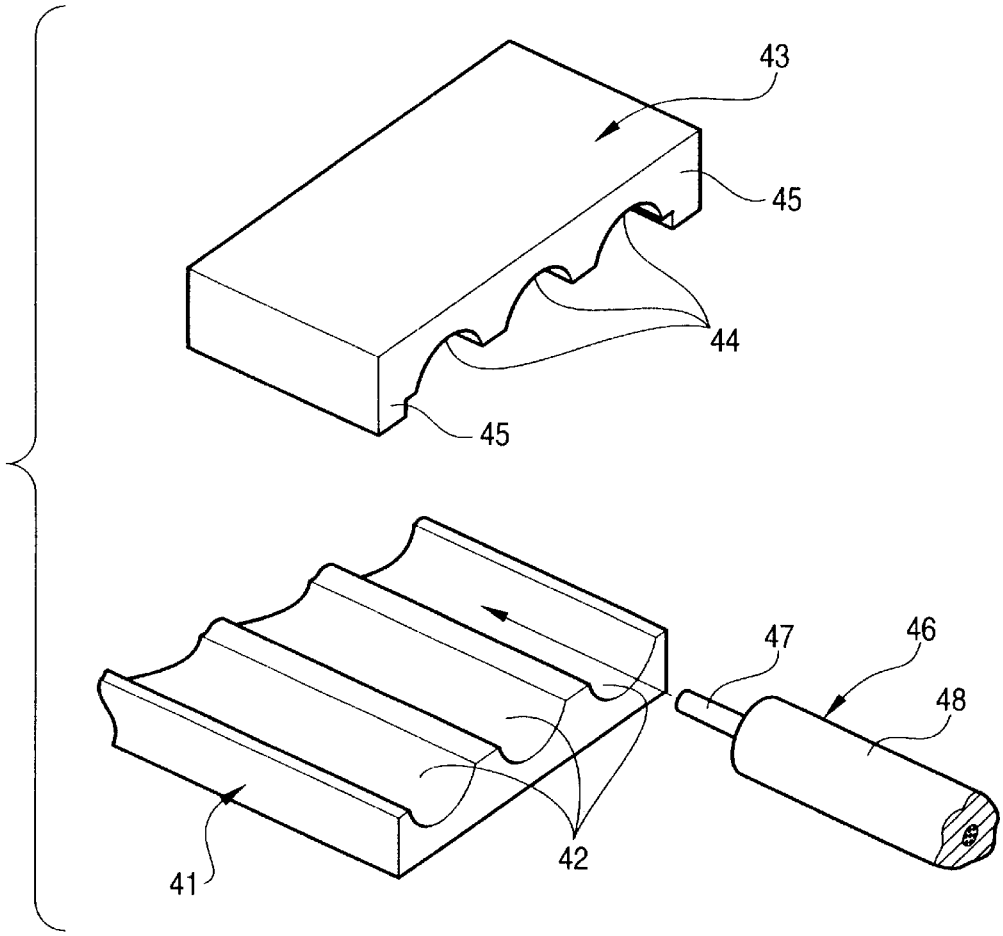
FIG. 4 is an exploded perspective view illustrating a waterproof structure of a connector according to a third embodiment of the present invention.
Figure 5:
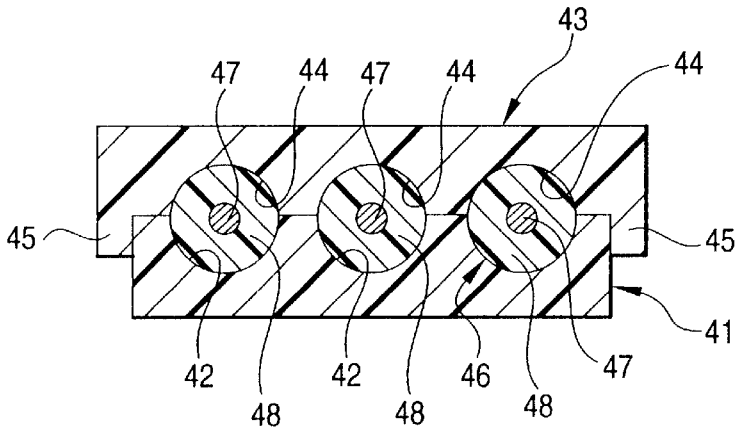
FIG. 5 is a cross sectional view illustrating a waterproof structure of a connector of FIG. 4.
Figure 6:
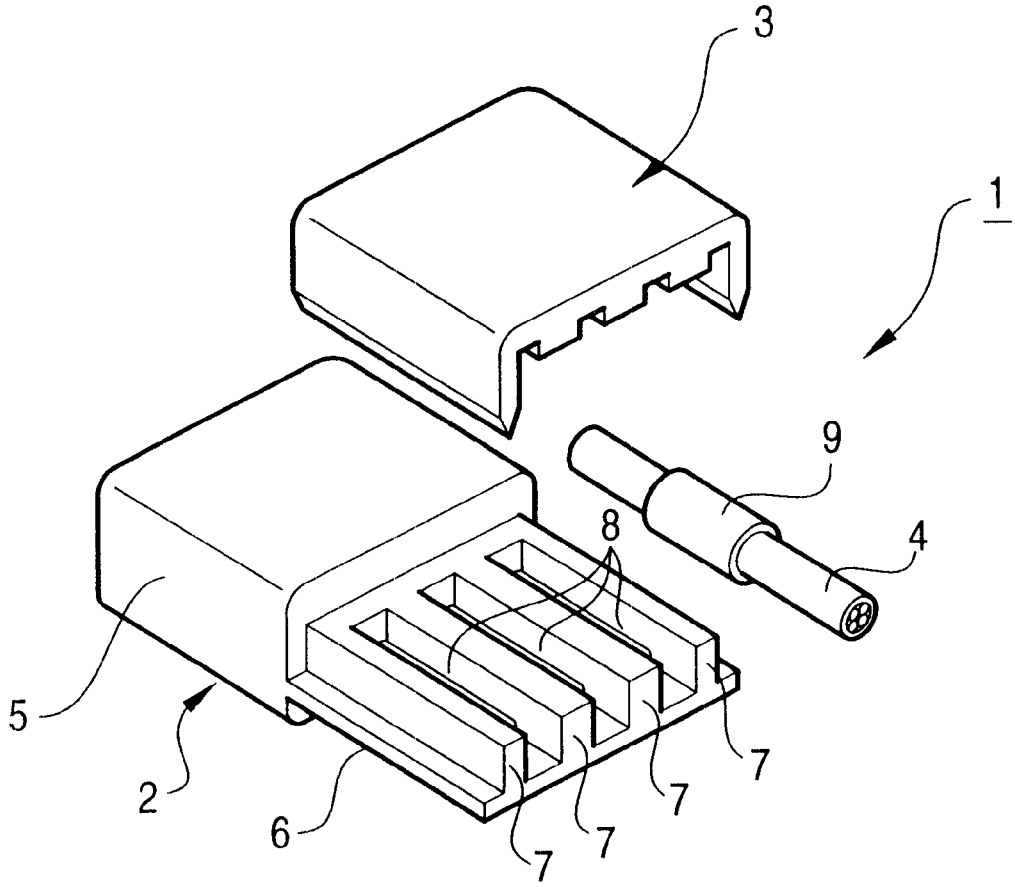
FIG. 6 is an exploded perspective view illustrating a related waterproof structure of a related connector.

FIG. 4 and FIG. 5 illustrate a third embodiment of a waterproof structure of a connector according to the present invention.

In the third embodiment, the wire leading part 41 is provided with the wire receiving grooves 42 being semi-circular in cross section for receiving a plurality of sheathed electric wires 46 arranged in parallel with respect to each other. The connector cover 43 is provided with the wire receiving grooves 44 being semi-circular in cross section opposed to the wire receiving grooves 42. The connector cover 43 is provided with side walls 45 arranged widthwise on both side faces thereof so as to abut against both side faces of the wire leading part 41. The sheathed electric wire 46 is formed by covering the lead 47 with the resin cover 48 being circular in cross section. The material of the resin cover 48 is thermoplastic elastomer as in the first embodiment described above.

FIG. 5 is a cross section of the waterproof structure of this embodiment illustrating the state that the resin covers 48 of the sheathed electric wires 46 are in intimate contact with the inner walls of the wire receiving grooves 42, 44. In such a configuration, the sheathed electric wires 46 are heat-welded to the connector members in absolute contact with each other, and thus giving a satisfactory waterproof ability. Specifically, in the third embodiment, since the wire receiving grooves 42, 44 are semi-circular in cross section and the sheathed electric wires 46 are circular in cross section, the wire leading part 41, the sheathed electric wire 46, and the connector cover 43 may be registered quite easily when they are connected and assembled. Other structure of the third embodiment is the same as the first embodiment described above.

While the descriptions are directed to the above embodiments, it is apparent that the present invention is not limited thereto, but various modifications in design coming with the substance of the structure may be made. For example, in each embodiment described above, while the material of the connector member is different resin material from the material of resin cover of the sheathed electric wire, it is also possible to use the same material for both of them. However, in the present invention, it is preferred that the resin cover is formed of copolymer included in the material of the connector in order to obtain compatibility with the sheathed electric wire.

What is claimed is:

1. A waterproof structure of a connector comprising:

a cover including a cover partition and a cover groove;

at least one electric wire covered by a resin sheath; and a connector body including:

a connecting part to which one end portion of the sheathed electric wire is connected; and a wire leading part made of a resin material and having a wire receiving groove defined by wire receiving walls for receiving the sheathed electric wire connected to the connecting part, the wire receiving groove having a cross sectional shape substantially identical with a cross sectional shape of the sheathed electric wire so that the inner surface of the wire receiving groove and the outer surface of the sheathed wire is heat-welded; wherein the cover partition is situated within the wire receiving groove and one of the wire receiving walls is situated within the cover groove.

2. The waterproof structure as set forth in claim 1, wherein the resin sheath integrally covers at least one end portions of a plurality of electric wires.

3. The waterproof structure as set forth in claim 1, wherein the resin sheath is made of a thermoplastic elastomer.

4. The waterproof structure as set forth in claim 3, wherein the thermoplastic elastomer is a copolymer including a resin material forming the wire leading part as a polymerized ingredient.

5. The waterproof structure as set forth in claim 1, wherein the cover is brought into an intimate contact with the sheathed electric wire received in the wire receiving groove; and wherein the cover is made of a resin material having compatibility with the resin material of the wire leading part to be heat-welded with the sheathed electric wire and the wire leading part.

6. The waterproof structure as set forth in claim 1, wherein the wire leading part and the sheathed wire are heat-welded by applying frictional heat energy generated by ultrasonic excitation.

7. The waterproof structure as set forth in claim 5, wherein the cover is heat-welded by applying frictional heat energy generated by ultrasonic excitation.

* * * * *